United States Patent [19]

Ruano et al.

[11] Patent Number: 4,492,671

[45] Date of Patent: Jan. 8, 1985

[54] METHOD FOR CONSOLIDATION OF IRON-BASED ALLOY POWDER BY CYCLIC PHASE TRANSFORMATION UNDER PRESSURE

[75] Inventors: Oscar Ruano, Madrid, Spain; Jeffrey Wadsworth, Menlo Park; Oleg D. Sherby, Palo Alto, both of Calif.

[73] Assignee: Leland Stanford Junior University, Stanford, Calif.

[21] Appl. No.: 358,365

[22] Filed: Mar. 15, 1982

[51] Int. Cl.[3] ..... B22F 3/16; B22F 3/14

[52] U.S. Cl. ..... 419/48; 419/49; 419/50; 419/51; 419/54; 419/15; 419/17

[58] Field of Search ..... 419/48, 49, 50, 51, 419/52, 53, 54, 15, 17

[56] References Cited

U.S. PATENT DOCUMENTS

| | | | |
|---|---|---|---|
| 2,637,671 | 5/1953 | Pavitt | 419/54 |
| 2,807,542 | 9/1957 | Frank | 419/54 |
| 3,772,009 | 11/1973 | Isaksson | 419/54 |

OTHER PUBLICATIONS

Kohara; "Effect of Repeated Allotropic Transformation on Sintering of Iron Powder"; Metall. Trans.; 1976; vol. 7; p. 1239.

Oshida; "An Application of Superplasticity to Powder Metallurgy"; J. Jpn. Soc. Powder and Powder Metallurgy, 1975, vol. 22, p. 147.

*Primary Examiner*—Ben R. Padgett
*Assistant Examiner*—Matthew A. Thexton
*Attorney, Agent, or Firm*—Flehr, Hohbach, Test, Albritton & Herbert

[57] ABSTRACT

A powder metallurgical method of consolidating iron-based alloy powder, particularly white cast iron, to form a body of high density in which the powder is thermally cycled above and below the alpha-gamma transformation temperature of below 800° C., and a stress of between 1.7 MPa and 34.5 MPa is simultaneously applied to the powder to form a high density consolidated body.

5 Claims, 2 Drawing Figures

METHOD FOR CONSOLIDATION OF IRON-BASED ALLOY POWDER BY CYCLIC PHASE TRANSFORMATION UNDER PRESSURE

BACKGROUND OF THE INVENTION

There is a need for a technique to form a consolidated product of enhanced densification from rapidly-solidified iron-based powders wherein the fine microstructures present in such powders are retained. In the past, it has been assumed that this requires low temperatures (e.g. less than 800° C.) to avoid coarsening of the microstructure. However, correspondingly high pressures or stresses would be required to form a product of high density. The use of extremely high pressures is a limiting factor in the manufacture of consolidated powder products. Thus, there is a need for reducing the pressure required at low temperatures for manufacture of a consolidated product of high densification.

One approach to densification of iron powders is suggested by S. Kohara, in "Effect of Repeated Allotropic Transformation on Sintering of Iron Powder", Metall. Trans., 1976, Vol. 7, p. 1239. Pure iron powder was utilized which has a transformation temperature of 910° C. Extremely small stresses of 10 psi (approximately 0.1 MPa) were applied. The limited enhancement of densification was attributed to the occurrence of transformation superplasticity.

Another approach was suggested by Y. Oshida, in "An Application of Superplasticity to Powder Metallurgy", J. Jpn. Soc. Powder and Powder Metall., 1975, Vol. 22, p. 147. There, the densification of cast iron powders by multiple thermal cycling through the $A_1$ transformation temperature (727° C. for Fe-C alloys) under small applied stresses of 70 to 210 psi (0.5 to 1.5 MPa) was investigated. The enhancement of densification was attributed to transformation superplasticity. However, experiments have shown that under the transformation cycling conditions employed by Oshida, significant densification would only be expected if stresses substantially above 1.5 MPa had been applied.

SUMMARY OF THE INVENTION AND OBJECTS

In accordance with the present invention, a powder metallurgical method of consolidating iron-based alloy powder, particularly white cast iron, having an alpha-gamma transformation temperature below 800° C., is utilized to form a high density body. The iron-based powder is thermally cycled at least above and below the alpha and $Fe_3C$-gamma and $Fe_3C$ transformation temperature (also called the $A_1$ temperature), and a stress of about 0.7 MPa to 34.5 MPa is applied simultaneously to the powder to form a high-density consolidated body. Densities can be achieved in excess of 95% of theoretical in a relatively short time period, utilizing moderate stresses.

It is an object of the invention to provide a method of consolidating iron-based alloy powder into a body of high density, utilizing relatively low temperatures and moderate stresses in a relatively short period of time.

It is a particular object of the invention to provide a system of the above type for consolidating white cast iron powder.

Further objects and features of the invention will be apparent from the following description taken in conjunction with the appendant drawing.

DETAILED DESCRIPTION OF THE PREFERRED EMBODIMENT

Figure 1:
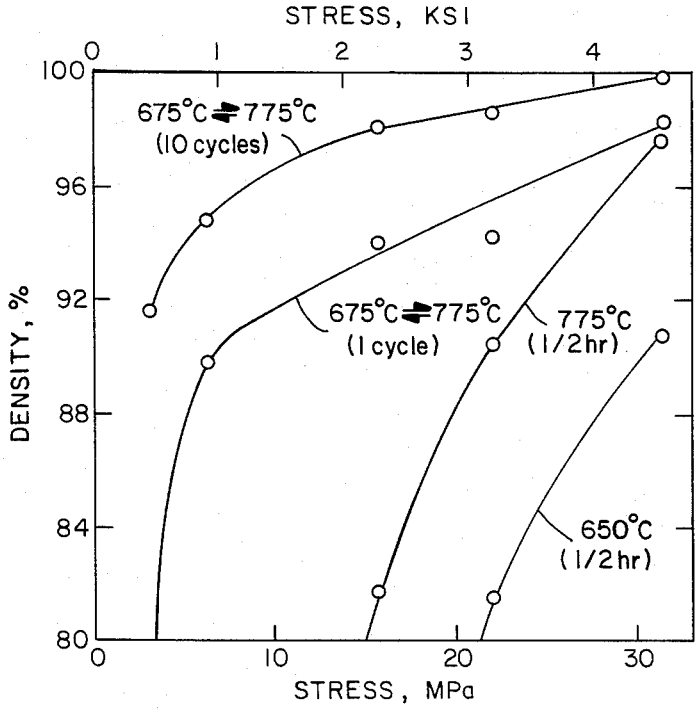
FIG. 1 is a diagram of percentage of theoretical density versus stress achieved as a function of multiple phase transformation, compared to that achieved under constant temperature heating.

In general, the technique of the present invention is applicable to any iron alloy with an alpha and $Fe_3C$-gamma and $Fe_3C$ transformation temperature below 800° C. At transformation temperatures above this level, the temperature required for thermal cycling is such that excessive coarsening of the microstructure may occur. The technique is particularly applicable to iron-carbon alloys, and specifically white cast iron with a typical carbon content of from 2.1 to 4.3 weight %. Unless otherwise specified herein, the term "iron alloy" will refer to white cast iron.

The present system may also be applicable to other iron-based systems with low alpha and $Fe_3C$-gamma and $Fe_3C$ transformation temperatures. One example is high alloy tool steel, where fine carbides and fine grain sizes are considered beneficial to room temperature properties. These fine structures are inherent in powders that are rapidly quenched. Utilizing the enhanced densification of the present invention, consolidation at temperatures where little carbide or grain coarsening occurs is possible. Another possible application of the transformation superplasticity of the present invention is that of iron-based materials with a low eutectoid temperature, such as the iron-nitrogen system. A eutectoid transformation occurs in this system at 590° C., and the eutectoid composition is found at 2.35 weight percent nitrogen. Thus, consolidation of fine grain structure powders in an iron-nitrogen system can be carried out at temperatures lower than in an iron-carbon system, leading to minimal coarsening of ultra-fine grain structures.

In general, the present method comprises thermally cycling the iron alloy powder at least once, and simultaneously applying a stress of from 1.7 MPa to 34.5 MPa, to form a high-density body. Referring to the thermal cycling conditions, it is preferable, to avoid excessive coarsening, that the upper temperature limit in the cycle be no greater than 800° C. The lower temperature of the cycle is not critical so long as it is below the alpha and $Fe_3C$-gamma and $Fe_3C$ transformation temperature. In an analogous manner, the upper temperature is not critical so long as it is above the alpha and $Fe_3C$-gamma and $Fe_3C$ transformation temperature. Thus, a cycle which is on the order of 10°-50° C. above and 10°-50° C. below the transformation temperature is sufficient. A suitable cycle for a white cast iron is from about 675° C. to 775° C., at a heating and cooling rate on the order of 5° C./minute. The number of cycles has an effect on the degree of densification which can occur for a given stress. Thus, increasing the number of cycles, e.g. from 2 to 10 cycles or more, lowers the required stress for that degree of densification. However, if for some reason, in excess of one cycle is not desired, densifications in excess of 98% can be achieved in a single cycle. On the other hand, densification in excess of 95% can be achieved with relatively low stress, e.g., less than 10 MPa.

Referring to the percentage of densification, it is preferable to achieve as high a densification as possible under practical treatment conditions. In accordance with the present invention, densifications from 90% to 100% can be achieved depending upon the conditions employed. Densifications of 95% or more are of particular benefit and can be achieved with moderate conditions in accordance with the invention. While one cycle can be employed, it is preferable to utilize in excess of 5 to 10 cycles where the application of low stresses are of overriding importance.

Referring to the stress levels, it is assumed that a true strain of at least 0.2 is required to cause full densification. To cause this strain in a reasonable time cycle, at least about 1.7 MPa, and preferably in excess of 5 to 15 MPa, is employed.

The total elapsed time for thermal cycling depends on a number of factors, including the heating and cooling rate, the maximum and minimum temperatures of the cycle, and the number of cycles. Thus, it has been found that suitable results are achieved with one thermal cycle in about 10 minutes, and for more thermal cycles the increase in total time duration is proportionate. It is desirable from a practical standpoint to minimize the cycle time to increase production rate.

In order to disclose more clearly the nature of the present invention, specific examples are hereinafter given. In each example, white cast iron powders were used having a chemical composition by weight % of 2.36 C, 0.92 Mn, 0.014 P, 0.14 Si, 0.0145 S, 0.018 Cr, balance Fe. These powders have a very fine microstructure as a result of preparation by the rapid solidification rate processing described in A. R. Cox, et al: Proc. Third International Symposium Superalloys, p. 45, Seven Springs PA, Claitor's Pub. Div., Baton Route, La., 1976. The particle size was measured using a Tyler mesh analysis. Microscopic examination of powders was carried out with both the scanning electron microscope (SEM) and the optical microscope.

Samples for densification studies were prepared in the following manner. The 2.4% C white cast iron powders were spread in a thin layer of about 120 microns thickness between two flat, mild steel plates that were degreased after surface grinding to remove oxide. After thermal cycling, the microstructure of the powders included fine particles of cementite in a ferrite matrix.

For all tests, warm pressing was performed in a resistance furnace attached to a 22,700 kg capacity, servo-hydraulic, MTS-testing machine programmed to deliver a constant load. Temperature was controlled +/−3° C. and measured using thermal couples at the top and bottom of the sample. An atmosphere of forming gas, 90% nitrogen-10% hydrogen, was used to minimize oxidation. In each instance where transformation cycling was used, the temperature was varied from 50° C. above to 50° C. below the $A_1$ transformation temperature (727° C.). The time for a complete cycle (675° C. to 775° C. and return to 675° C.) was about 8 minutes.

The particle size distribution of the as-quenched like cast iron powders is set forth in the following Table 1.

TABLE 1

SCREEN ANALYSIS FOR 2.4% C WHITE CAST IRON POWDERS

| Tyler Screen Mesh Size, μm | 45 | 45 | 64 | 106 | 150 | 180 |
|---|---|---|---|---|---|---|
| % of Charge Weight Trapped | 39 | 24 | 28 | 8 | 1 | 0 |

The average size of particles was 45 microns. In general, the particles had a spheroid shape, although some particles showed irregular forms. The as-quenched microstructure of the particles was a complex one consisting of retained austenite, carbides, and some martensite. This microstructure changes drastically after annealing for short times (e.g., 15 minutes) at 650° C. No further significant changes were observed after longer annealing times at 650° C. The annealed microstructure includes a fine mixture of cementite and ferrite.

White cast iron 2.4% carbon powders were warm pressed over a range of applied stresses (3 to 70 MPa) using five different thermal-pressure histories summarized in Table 2.

In Route 1, a single transformation cycle between 675° C. and 775° C. was used with various applied stresses. The samples were loaded prior to heating and the pressure was maintained for the entire test. In Route 2, 10 transformation cycles were performed for each of a variety of applied stresses. The approximate total times that the samples were held at temperature, during a full transformation cycle, were 8 minutes for Route 1 and 8 minutes for Route 2.

TABLE II

DENSIFICATION STUDIES OF WHITE CAST IRON POWDERS USING FIVE DIFFERENT ROUTES

| | Thermal History | Number of cycles under stress | Pressures used, MPa, and densities achieved (%) |
|---|---|---|---|
| ROUTE 1 | 675° C. ⇄ 775° C. | 1 (8 min) | 3.1(<80), 6.3(89.8), 15.7(94.0), 21.9(94.2), 31.3(98.3) |
| ROUTE 2 | 675° C. ⇄ 775° C. | 10 (80 min) | 1.6(<80), 3.1(91.6), 6.3(94.8), 15.7(98.1), 21.9(98.6), 31.3(100) |
| ROUTE 3 | 650° C., ½ hr. | 0 | 6.9(<80), 15.7(81.6), 31.3(90.7), 48.3(97.2), 68.9(100) |
| ROUTE 4 | 650° C., 2 hrs. | 0 | 6.9(<80), 13.8(90.4), 34.5(96.4), 48.3(98.9), 68.9(100) |
| ROUTE 5 | 775° C., ½ hr. | 0 | 6.9(<80), 15.7(81.8), 21.9(90.5), 31.3(97.7) |

The influence of time at a constant temperature of 650° C. under pressure was investigated by holding samples at this temperature for ½ hour (Route 3) and 2 hours (Route 4) under a range of applied stresses. In Route 5, samples were heated to 775° C., without applied stress, and then the pressure was applied for ½ hour and removed prior to cooling. Thus, the influence of pressure on densification at 775° C. was evaluated without the contribution of a transformation-induced strain.

Figure 2:
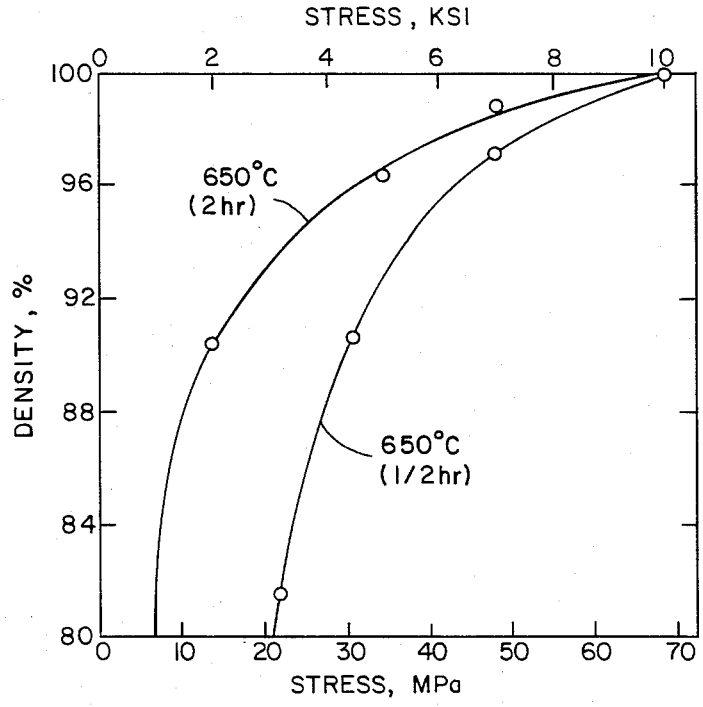
FIG. 2 is a diagram of percentage of theoretical density versus stress of two samples held at the same temperature for different times.

The results of routes 1, 2, 3 and 5 are illustrated in FIG. 1. The influence of higher stresses on densification at 650° C. of routes 3 and 4 is illustrated in FIG. 2. At the highest stress employed (60 MPa), full densification was observed at 650° C. after times of ½ hour and 2 hours. At pressures lower than 60 MPa, the increase of time at a given applied stress leads to an increased density. At an applied pressure of 20 MPa, for example, less than 80% densification is observed after ½ hour at 650° C., whereas over 90% densification is observed after 2 hours at 650° C.

Referring again to the drawing, the density is shown to increase with an increase in applied stress. The figure clearly demonstrates that transformation cycling during the application of an externally applied stress is a major factor enhancing densification. For example, under a low externally applied stress of 6.9 MPa, the consolidated body has a density of over 95% when treated for ten cycles; on the other hand, when treated for one cycle, it has a density of 90%. In contrast, densities substantially less than 80% are found for the warm-pressed samples at both 650° C. and 775° C. Transformation cycling also enhances the densification of white cast iron powders at high applied stresses. For example, at 20 MPa, 99% densification occurs for a ten cycle treatment, while 95% densification is found for a one cycle treatment. Without temperature cycling, only 90% densification is found after warm pressing for ½ hour at 775° C., and less than 80% densification is found after warm pressing for ½ hour at 650° C.

The drawing illustrates that high densification can be achieved in a short time by utilizing transformation cycling under small applied stresses. For example, a 98% dense product is obtained in only 8 minutes when transformation cycled once under an applied stress of 31 MPa. This is to be contrasted with only 90% densification after 30 minutes at 650° C., under the same stress, where no transformation cycling is performed. These results suggest a practical utility for transformation cycling in the manufacture of powder metallurgy products because of the short times, low temperatures, and low stresses required to achieve full densification.

Under the thermal cycling conditions above, the fine initial microstructures of the original powders are retained in the final consolidated bodies. Some coarsening of the carbides occurs after ten cycles. This is believed to be the result of the combined effect of strain and time at elevated temperatures. In contrast, in the structure after one hour at 850° C., a temperature above the preferred range herein, marked coarsening of the microstructure is found. This illustrates the importance of using low temperatures and short times in powder metallurgy compaction where retention of fine structure is desired. Typical pressing temperatures for iron-based powders in current commercial practice are 950° C.–1050° C.

The preferred limits of stresses during transformation cycling, namely, 1.7 to 30 MPa, are supported by the figure. The upper preferred limit is illustrated by the fact that the density of the white cast iron compact product is nearly the same, with or without transformation cycling, at stresses close to 30 MPa. Normal slip processes dominate the densification at and above this upper boundary of stress, and therefore little benefit is obtained from transformation superplasticity.

The lower stress limit is about 1.7 MPa. At or below this stress, even after a large number of transformation cycles, poor densification is achieved. At 1.7 MPa, the data indicates that less than 90% densification is achieved even after ten cycles. This number of cycles requires 80 minutes of warm pressing. In order to achieve the practical goal of nearly full densification at 1.7 MPa, a number of hours of transformation cycling would be required, which typically would not be practical.

One conclusion that can be drawn from the foregoing is that when materials are subjected to an externally applied stress during phase transformations, high strain rate sensitivities and low strength can result. This phenomenon, known as phase transformation superplasticity, can be utilized to enhance densification of powders. The factors affecting the strain that occurs upon transformation are: volume change upon transformation, strength of the phases involved, applied stress, and heating and cooling rate. Further based on the foregoing, the preferred range of stresses is from 1.7 MPa to 34.5 MPa for ferrous metals that exhibit transformations in the range of 727° to 800° C. to achieve significant total strains, e.g., approximately 10%, in less than 50 thermal cycles. Below 1.7 MPa, too many cycles for many practical applications are required to generate significant strains. Above 34.5 MPa, normal creep processes can dominate deformation. A major benefit of utilizing low temperatures in short times is that fine structure within the powders are retained, in contrast to conventional consolidation techniques were the high temperatures used tend to cause rapid coarsening of the structure.

What is claimed is:

1. A powder metallurgical method of consolidating iron-based alloy powder having an alpha-gamma transformation temperature below 800° C. to form a body of high density, comprising thermally cycling the iron-based powder at least once above and below the alpha-gamma transformation temperature, and simultaneously applying a stress of from about 5 MPa to about 34.5 MPa to the powder to form a high density consolidated body.

2. The method of claim 1 in which the powder comprises an iron-carbon alloy.

3. The method of claim 2 in which the alloy comprises a white cast iron powder.

4. The method of claim 1 in which the density of the consolidated body is at least 95%.

5. The method of claim 1 in which the maximum temperature during cycling is below about 800° C.

* * * * *